US005960730A

United States Patent [19]

Picker

[11] Patent Number: 5,960,730

[45] Date of Patent: Oct. 5, 1999

[54] PRESSER FOOT ACTUATING DEVICE

[75] Inventor: Arthur Picker, Steinhagen, Germany

[73] Assignee: Durkopp Adler, Germany

[21] Appl. No.: 09/108,027

[22] Filed: Jun. 30, 1998

[30] Foreign Application Priority Data

Jul. 5, 1997 [DE] Germany ..... 197 28 817

[51] Int. Cl.[6] ..... D05B 29/02

[52] U.S. Cl. ..... 112/237

[58] Field of Search ..... 112/235, 237, 112/238, 239, 60, 61, 114, 320

[56] References Cited

U.S. PATENT DOCUMENTS

| | | | |
|---|---|---|---|
| 4,024,826 | 5/1977 | Knight et al. | 112/235 |
| 4,658,752 | 4/1987 | Keilmann et al. | 112/253 |
| 4,981,094 | 1/1991 | Stapel et al. | 112/235 |
| 5,138,962 | 8/1992 | Klundt | 112/237 |
| 5,540,163 | 7/1996 | Reinhart et al. | 112/235 |

FOREIGN PATENT DOCUMENTS 8123748 8/1984 Germany .

3907240 10/1989 Germany .

OTHER PUBLICATIONS

*Pneumatic Cylinder Catalog* (Pneumatic Main Catalog), 22nd Edition, p. 1.211–3, FESTO Pneumatic Esslingen.

*Primary Examiner*—Ismael Izaguirre
*Attorney, Agent, or Firm*—Ostrolenk, Faber, Gerb & Soffen, LLP

[57] ABSTRACT

An actuating device (54) for lifting the presser foot (53) of a sewing machine. A piston (14) having a piston rod (15) is supported on the bearing (13) which guides the presser foot support rod (18). The presser foot support rod (18) is biased against the sewing material by a spring (40). The piston (14) is surrounded by a cylinder (26). The piston (14) with the piston rod (15) and the cylinder (26) form a piston-cylinder drive for actuation by compressed air, to urge the piston rod (15) against the force of the spring (40) and thereby lift the presser foot (53) off of the sewing material. The actuating device (54) has two set screws (42, 45) which respectively control the spring force acting on the presser foot and the distance the presser foot is raised by the actuating device. Two embodiments are described.

10 Claims, 2 Drawing Sheets

PRESSER FOOT ACTUATING DEVICE

BACKGROUND OF THE INVENTION

The present invention relates to an actuating device for the presser foot of a sewing machine.

A known actuating device for a presser foot is disclosed in DE 36 04 299 C2 (corresponding to U.S. Pat. No. 4,658,752). A sewing machine is disclosed which has a presser foot drive in the form of a double-acting pneumatically operated piston-cylinder drive. In more detail, the piston rod of the piston-cylinder drive is directly connected to the presser bar, and the cylinder and the piston are connected with the piston bar aligned with the presser foot bar. Within the cylinder, a prestressed compression spring presses the piston and thus presses the presser foot bar together with a presser foot arranged thereon against sewing material which is present on the base plate of the sewing machine. Upon corresponding action of compressed air on the piston-cylinder drive, the presser foot is raised against the force of the spring. The force of the spring is predetermined by its design.

One disadvantage of the known presser foot device is that particular care is needed with respect to its design in order, on the one hand, to arrange it exactly in alignment with the second bearing which guides the presser foot bar and, on the other hand, to assure a continuous sealing of the presser foot bar from the pressure chamber of the pneumatic cylinder. Beyond this, no information can be obtained from the literature as to how the actuating device which is developed in the form of the pneumatic cylinder is to be developed with respect to proper manufacture and assembly.

This presser foot has the further disadvantage that the operator cannot adjust the force applied by the spring as well as the stroke length by which the presser foot can be lifted off the material being sewn, in accordance with the requirements of the specific operation for the production of a seam.

Federal Republic of Germany Utility Model 81 23 748 discloses a presser foot device of a sewing machine in which the spring force acting on the presser foot bar and the position of the presser foot in its lower position can be adjusted by set screws. The presser foot device has an actuating device provided with a pneumatic cylinder which is assembled from a considerable number of structural parts.

Pneumatic cylinders with hollow piston rods are shown on a page from the *Pneumatic Cylinder Catalog* (Pneumatic Main Catalog), 22nd Edition, page 1.211–3, FESTO Pneumatic Esslingen.

DE 39 07 240 A1 shows an actuating device for the presser foot of a sewing machine, in which a presser foot is articulated on a lever which extends substantially horizontally and is swingable around the horizontal, and in which this lever can be actuated by a piston-cylinder drive. This piston-cylinder drive can act in any direction whatsoever; it is merely necessary to assure that a torque is still produced around the swivel axis of the lever. This known actuating device does not correspond to the actuating device of the type involved herein. The problems occurring in the actuating device of the type concerned herein also do not occur with the actuating device of the reference, and the features proposed in accordance with the present invention are also not known from the reference.

SUMMARY OF THE INVENTION

The present invention remedies the foregoing disadvantages of the prior art by providing an actuating device for the presser foot of a sewing machine having a simple construction and having dependable guidance of its moving parts.

These advantages may be achieved with an actuating device for a presser foot of a sewing machine, having a piston-cylinder drive which has a bore hole through which the presser foot support bar extends; the piston-cylinder drive being arranged in contact with a housing of the sewing machine, preferably on a bearing on the housing, and also in contact with a driver which is connected to the presser foot support bar. Since the piston-cylinder drive has a bore and the presser foot bar extends through the bore, the construction of the piston-cylinder drive avoids any difficulties due to errors in alignment, is very simple to assemble, and consists of few structural parts, and thus can be produced inexpensively.

The piston-cylinder drive may be arranged to apply an opposing force (F2) along the longitudinal axis which opposes a spring force (F1) which biases the presser foot against the material being sewn. This feature leads to a reduction in the force required to lift the presser foot. Since the spring force and the opposing force are applied along the same longitudinal axis, friction-causing torque is not generated by the two forces.

According to one embodiment of the invention, the piston of the piston-cylinder drive is mounted directly on a bearing on the sewing machine housing. By this feature, advantages in the production process and a reduction in manufacturing and assembly costs are obtained. Furthermore, this results in a relatively longer guide surface for the presser foot rod.

Alternatively, according to another embodiment, the cylinder of the piston-cylinder drive may be mounted directly on the bearing, which leads to several structural parts being combined, and the corresponding advantages, and leads to the movable parts of the piston-cylinder drive having a comparably small mass.

Twisting of the presser foot rod may be prevented by providing the rod with a clamping part having an arm which is mounted with clearance in a guide mounted on the housing and extending parallel to the longitudinal axis of the rod.

The spring is advantageously arranged acting at one end against the driver on the presser foot rod, and on the other end against a support bearing attached to the housing, the support bearing having a first set screw which is received in the housing of the sewing machine, so as to permit the operator to easily adjust the spring force acting on the presser foot.

The first set screw is advantageously mounted in a second set screw which has at its lower end a resting surface which limits the path (h) of the piston-cylinder drive, so as to permit the operator to change the path or stroke of the presser foot easily.

The second set screw may comprise a tube on which the resting surface is formed, the tube providing a protective enclosure of some of the structural parts of the actuating device against excessive lubricant and/or dirt.

Other features and advantages of the present invention will become apparent from the following description of embodiments of the invention which refers to the accompanying drawings.

DETAILED DESCRIPTION OF EMBODIMENTS OF THE INVENTION

Embodiment 1

Figure 1:
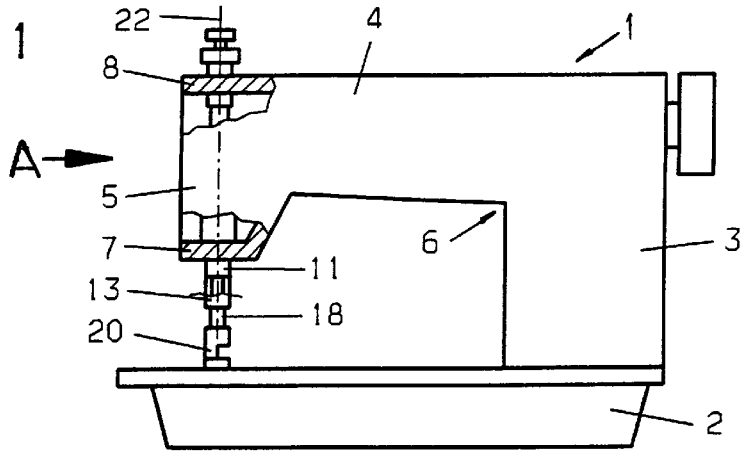
FIG. 1 is a front view of a sewing machine.

Referring to FIG. 1, a sewing machine 1 comprises a base plate 2, a hollow stand 3 arranged thereon, and an arm 4 extending from the stand 3. The arm 4 terminates in a head 5. The stand 3 and the arm 4 including the head 5 form a housing 6. This housing has a lower wall 7 and an upper wall 8 in the region of the head 5. Within the head 5 there are located in customary manner drive elements for the upward and downward drive of a needle bar 9 including needle 10 arranged thereon. The needle bar 9 is located with a clearance within a bearing bushing 11 which is fastened in the lower wall 7.

Figure 2:
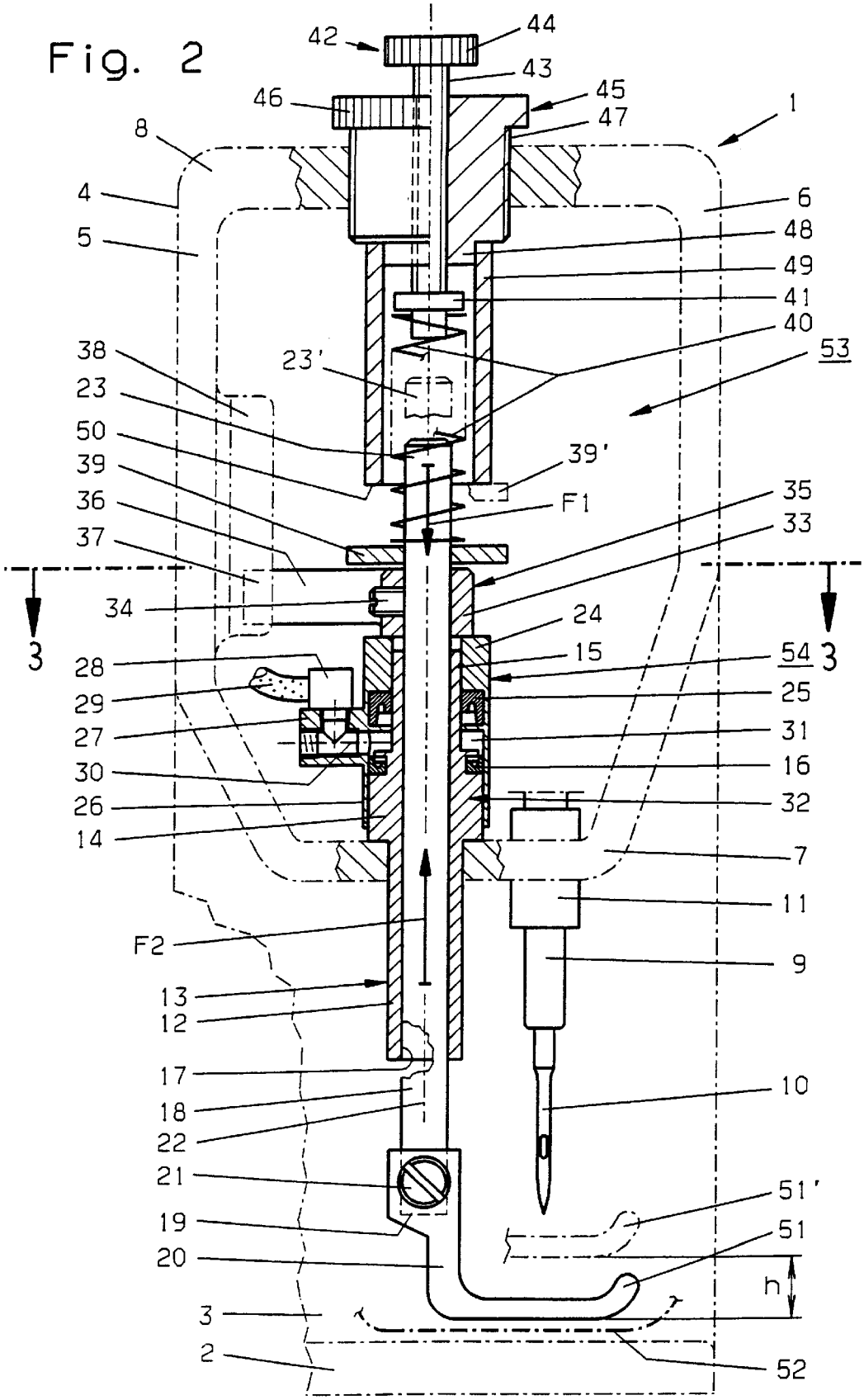
FIG. 2 is a side view of the sewing machine taken in the direction indicated by the arrow A in FIG. 1, with structural parts of Embodiment 1 shown in cross-section.

As seen in FIGS. 1 and 2, in the lower wall 7 is a bearing 13 having a tubular part 12 which is pressed firmly in place in the lower wall 7 and extends downward. Above the lower wall 7, the bearing 13 has a thicker cylindrical part which defines a piston 14. Extending upward from the piston 14 is a further tubular part which forms a piston rod 15. Finally, the piston rod 15 has an annular groove within which a packing ring 16 is received.

The parts mounted on the bearing 13, such as the tubular part 12, the piston 14 and the piston rod 15, are produced from one piece of bearing material, for example bronze. They are all concentric with each other and collectively define a bearing bore 17 which extends through them.

Within the bearing bore 17 a rod 18 is displaceably supported without perceptible clearance. The rod 18 has an end 19 facing the base plate 2, on which a presser foot 20 is fastened by a threaded connection 21. The rod 18 is circular in cross-section with a longitudinal axis 22 and without any shoulder.

On the tubular piston rod 15 there is displaceably mounted a bearing piece 24 which has a recess with a packing ring 25 contained therein and a downward-extending tubular cylinder 26. Also arranged on the bearing piece 24 is a radially extending extension 27 having a connecting piece 28 which receives an elastic hose 29. Within the extension 27 is a supply channel 30 for a compressed pressure fluid which can be fed through the hose 29. The supply channel 30 discharges into an annular pressure chamber 31.

The arrangement of the packing ring 16 on the piston 14 forms a seal of the pressure chamber 31 against the inner wall of the cylinder 26. The arrangement of the packing ring 25 in the recess in the bearing piece 24 forms a seal of the pressure chamber 31 against the piston rod 15. The piston 14, the piston rod 15 and the cylinder 26 accordingly form a piston-cylinder drive 32.

Figure 3:
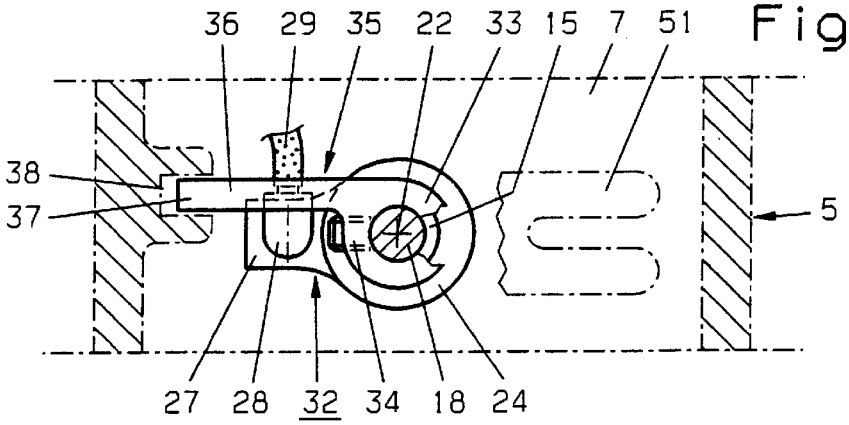
FIG. 3 is a sectional view taken along the sectional line 3—3 shown in FIG. 2.

Referring to FIGS. 2 and 3, a clamping part 33 is fastened on the rod 18 by a set screw 34, the clamping part 33 being in the shape of a set screw collar surrounding the rod 18. The clamping part 33 is a component of a driver 35 which has a radially extending arm 36. The free end 37 of the arm 36 is received with play in a guide 38 which is developed in a U-shape to grip the end 37 as shown in FIG. 3. The guide 38 extends substantially parallel to the longitudinal axis 22 of the rod 18.

On the top of the clamping part 33 there lies a disk 39 which is guided with play on the rod 18 and on which there rests the lower end (FIG. 2) of a prestressed coil compression spring 40. The free upper end of the compression spring 40 rests on a support bearing 41 on the lower end of a first set screw 42. The set screw 42 furthermore has an external thread 43 and a knurled edge 44. The set screw 42 is received turnably with its external thread 43 within a corresponding internal thread of a second set screw 45. The second set screw 45 also has a knurled edge 46. Furthermore, the set screw 45 has an external thread 47 and is received in a corresponding threaded bore in the upper wall 8. The set screws 42 and 45 are preferably constructed with fine threads so as to resist being inadvertently turned as a result of vibrations of the sewing machine 1.

On the second set screw 45 there is provided an extension 48. A tube 49 having a resting surface 50 on its lower end is fastened to the extension 48. As can be noted from FIG. 2, the tube 49 surrounds the upper end 23 of the rod 18 and a substantial part of the compression spring 40, without contacting them, and thereby provides a protective enclosure of those parts.

The compression spring 40 is dimensioned and prestressed so that it exerts a force F1 which is transmitted via the disk 39 and the clamping part 33 to the rod 18. The rod 18 holds a sole plate 51 arranged on the presser foot 20 against the material being sewn 52, which rests on the base plate 2.

The structural parts described above, such as the rod 18 with the presser foot 20 applied thereon, the bearing 13 receiving the rod 18, the driver 35, the disk 39, the compression spring 40 and the set screw 42 form a presser foot 53. The piston-cylinder drive 32 described above, including the structural parts conducting the compressed air such as the hose 29, the connecting piece 28 with the supply channel 30 developed therein, form an actuating device 54.

Figure 4:
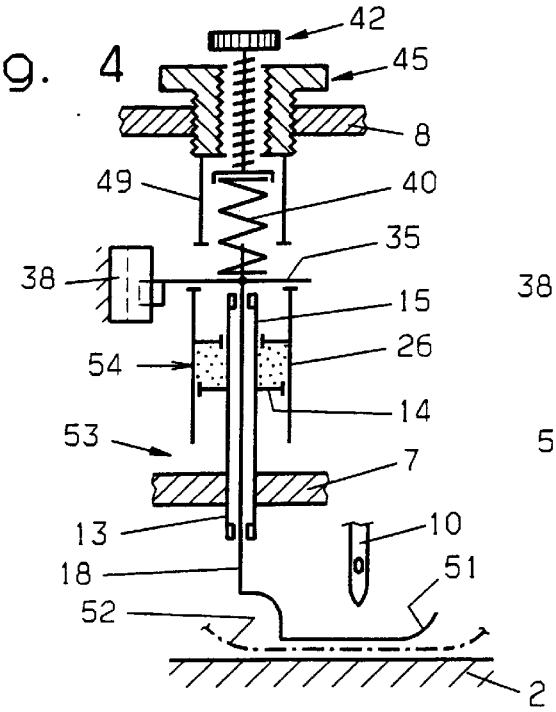
FIG. 4 is a diagrammatic showing of the actuating device in accordance with Embodiment 1.

The structure of Embodiment 1 is shown schematically in FIG. 4.

With the structure of Embodiment 1, forces F1 and F2 act along the longitudinal axis 22 which thus also represents the line of action of the forces F1 and F2. In principle, however, the invention can also be carried out with the forces F1, F2 acting along different lines of action and at different distances from the longitudinal axis 22.

Manner of Operation

As shown in FIGS. 2 and 4, the actuating device 54 for the presser foot 53 is in a condition in which no compressed air is being fed to the piston-cylinder drive 32, so that the sole plate 51 of the presser foot 20 rests with the force F1 on the material being sewn. The piston-cylinder drive 32 is located in this condition in its retracted position, the cylinder 26 being at a distance of, for instance, 2 mm from the lower wall 7; and similarly, the driver 35 being at a distance of, for instance, 2 mm from the upper edge of the piston rod 15.

Then, when compressed air is fed through the hose 29, the pressure chamber is supplied with air, so that the bearing piece 24, with the cylinder 26 contained therein, is displaced by a force F2 in the direction towards the upper wall 8. Since the force F2 is greater than the force F1 exerted by the compression spring 40, and acts against it, the force F2 will hereinafter be referred to as the opposing force F2.

With the upward movement of the cylinder 26, a displacement of the driver 35, of the rod 18 attached to it, and of the slidable disk 39 resting thereon, takes place against the force F1 of the compression spring 40. The compression spring 40 is compressed until the disk 39 comes to rest against the resting surface 50. This condition is shown by the structural parts shown in dashed lines such as the end 23', the disk 39', and the sole plate 51' (FIG. 2). It is also seen that the rod 18 has lifted-off from the sewing material 52 by a distance h, which is shown as the displacement between the sole plates 51 and 51'. The presser foot 53 is accordingly movable back and forth between a lower end position in which the sole plate rests on the material being sewn 52 and an upper end position in which the sole plate 51 is at a distance h above the material being sewn.

Due to the driver 35, with the end 37 of its arm 36 held displaceably in the guide 38, the rod 18 is secured against turning despite any upward and downward movements.

By turning the first set screw 42, the force F1 of the compression spring 40, and therefore the force with which the sole plate 51 presses against the material being sewn 52 against the base plate 2, can be adapted to the specific operating conditions of the sewing machine 1. By turning the second set screw 45, the distance h can be adapted suitably to the specific operating conditions of the sewing machine 1.

Embodiment 2

Figure 5:
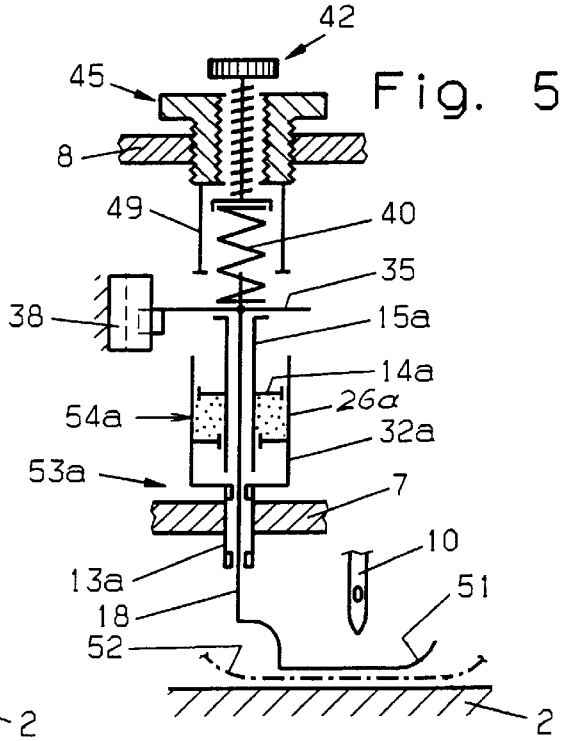
FIG. 5 is a diagrammatic view of the actuating device according to Embodiment 2.

The construction of Embodiment 2 is described with reference to FIG. 5. Here, structural parts which are similar to those in FIGS. 1–4 will not be described again. Those parts which are different from corresponding parts in Embodiment 1 are designated with the corresponding reference numerals with an added letter a.

On the bearing 13*a* is mounted a cylinder 26*a* which is nondisplaceable relative to the lower wall 7 of the head 5. The piston rod 15*a* is mounted displaceably on the rod 18. Thus, in this case, the piston rod 15*a* is displaceable with respect to the wall 7 of the head 5. These structural parts, including the cylinder 26*a,* the piston 14*a,* and the piston rod 15*a* which is connected therewith, form a piston-cylinder drive 32*a.*

The piston-cylinder drive 32*a,* including the structural parts guiding the compressed air such as those described in connection with Embodiment 1, forms an actuating device 54*a.*

Manner of Operation

The operation of Embodiment 2 corresponds to that of Embodiment 1, except for the fact that in this case the lifting of the rod 18 against the force F1 of the compression spring 40 is effected by the piston rod 15 which moves toward the upper wall 8.

Although the present invention has been described in relation to particular embodiments thereof, many other variations and modifications and other uses will become apparent to those skilled in the art. Therefore, the present invention is not limited by the specific disclosure herein.

What is claimed is:

1. An actuating device for a presser foot of a sewing machine, the actuating device comprising:

a presser foot rod for supporting the presser foot, the rod having a driver attached thereto, the rod having a longitudinal axis;

the rod being adaptable for being mounted on a housing of the sewing machine for being displaceable in the direction of the longitudinal axis between two end positions;

a support bearing which is adaptable for being mounted on the housing and supporting one end of a spring;

another end of the spring being supported on the driver on the presser foot rod, the spring urging the rod toward a lower end position thereof by a spring force acting along the longitudinal axis;

the actuating device comprising a piston-cylinder drive for receiving a pressure fluid, and in response thereto, applying an opposing force directed upward against the spring force, the opposing force being greater than the spring force and thereby being capable of urging the rod into an upper end position thereof;

the piston-cylinder drive applying the opposing force against the driver attached to the presser foot rod; and the piston-cylinder drive having a bore hole and the presser foot rod extending through said bore hole.

2. An actuating device according to claim 1, wherein the piston-cylinder drive applies said opposing force along said longitudinal axis.

3. In combination, the actuating device according to claim 1, and a sewing machine having a housing and including a presser foot;

the rod being mounted on the housing;

the support bearing being mounted on the housing;

the piston-cylinder drive being mounted on the housing; and the presser foot being mounted on the presser foot rod.

4. An actuating device according to claim 3, wherein the piston of the piston-cylinder drive is mounted directly on the housing.

5. An actuating device according to claim 3, wherein the cylinder of the piston-cylinder drive is mounted directly on the housing.

6. An actuating device according to claim 3, wherein the driver is attached to the presser foot rod by a clamping part, an arm extending from the clamping part and being guided with clearance in a guide attached to the housing, the guide extending parallel to the longitudinal axis of the rod.

7. An actuating device according to claim 3, wherein the support bearing for the spring has a first set screw which is received in the housing and is adjustable for setting the tension of the spring.

8. An actuating device according to claim 7, wherein the first set screw is mounted in a second set screw having a resting surface which is arranged to limit the upward movement of the piston-cylinder drive.

9. An actuating device according to claim 8, wherein the resting surface of the second set screw is defined by the lower end of a tube connected to the second set screw.

10. An actuating device according to claim 9, wherein the resting surface of the second set screw is arranged for engaging a stop which is mounted on the presser foot rod so as to stop the presser foot rod in the upper position thereof.

* * * * *